US007481160B1

(12) United States Patent
Simon et al.

(10) Patent No.: US 7,481,160 B1
(45) Date of Patent: Jan. 27, 2009

(54) SYSTEM AND METHOD FOR CONTROLLING COMPACTOR SYSTEMS

(75) Inventors: Jay S. Simon, Northbrook, IL (US); Martin J. Durbin, Oak Forest, IL (US)

(73) Assignee: One Plus Corp., Northbrook, IL (US)

( * ) Notice: Subject to any disclaimer, the term of this patent is extended or adjusted under 35 U.S.C. 154(b) by 0 days.

(21) Appl. No.: 11/621,822

(22) Filed: Jan. 10, 2007

Related U.S. Application Data

(60) Provisional application No. 60/758,798, filed on Jan. 14, 2006.

(51) Int. Cl.
*B30B 15/18* (2006.01)
*B30B 15/22* (2006.01)

(52) U.S. Cl. ..... 100/50; 100/35; 100/51; 100/99; 100/229 A; 100/269.01; 60/329; 73/54.04; 702/50

(58) Field of Classification Search ..... 100/35, 100/43, 48, 50, 51, 99, 229 R, 229 A, 269.01, 100/269.05, 271, 299; 60/329; 417/212–218; 73/54.04; 702/50, 53, 188
See application file for complete search history.

(56) References Cited

U.S. PATENT DOCUMENTS

| | | | | |
|---|---|---|---|---|
| 4,274,282 | A * | 6/1981 | Budraitis et al. | 73/862.625 |
| 4,603,625 | A | 8/1986 | Brown | |
| 4,773,027 | A | 9/1988 | Neumann | |
| 4,817,520 | A | 4/1989 | Brown et al. | |
| 4,896,593 | A | 1/1990 | Slusser | |
| 4,953,109 | A | 8/1990 | Burgis | |
| 5,016,197 | A | 5/1991 | Neumann et al. | |
| 5,078,451 | A | 1/1992 | Sobel | |
| 5,214,594 | A | 5/1993 | Tyler et al. | |
| 5,299,493 | A | 4/1994 | Durbin et al. | |
| 5,303,642 | A | 4/1994 | Durbin et al. | |
| 5,514,338 | A | 5/1996 | Simon et al. | |
| 5,558,013 | A | 9/1996 | Blackstone, Jr. | |
| 5,626,086 | A | 5/1997 | Malone | |
| 5,967,028 | A | 10/1999 | Schomisch et al. | |
| 6,021,712 | A | 2/2000 | Harrop | |
| 6,055,902 | A | 5/2000 | Harrop et al. | |
| 6,123,017 | A | 9/2000 | Little et al. | |
| 6,236,332 | B1 | 5/2001 | Conkright et al. | |
| 6,360,186 | B1 | 3/2002 | Durbin | |
| 6,408,261 | B1 | 6/2002 | Durbin | |
| 6,453,270 | B1 | 9/2002 | Durbin | |
| 6,561,085 | B1 | 5/2003 | Durbin et al. | |
| 6,687,656 | B2 | 2/2004 | Durbin et al. | |
| 6,738,732 | B2 | 5/2004 | Durbin et al. | |
| 2005/0087001 | A1 * | 4/2005 | Irani | 73/54.04 |

* cited by examiner

*Primary Examiner*—Jimmy T Nguyen
(74) *Attorney, Agent, or Firm*—Patzik, Frank & Samotny Ltd.

(57) ABSTRACT

An integrated system for: complete waste compactor operational control; remote fullness monitoring; and, remote performance and maintenance diagnostics. Such diagnostic information is transferred wirelessly or otherwise to one or more recipients, so as to directly provide a critical warning in real time.

The waste compactor controller/monitor system allows for periodic real-time oil viscosity measurements of the hydraulic fluid to account for changes in such viscosity. The system adjusts the timing of the compactor stroke to permit more efficient operation and inhibit damage to the hydraulic ram and/or container during use.

30 Claims, 9 Drawing Sheets

SYSTEM AND METHOD FOR CONTROLLING COMPACTOR SYSTEMS

This application claims the benefit of U.S. provisional patent application Ser. No. 60/758,798, filed Jan. 14, 2006.

FIELD OF THE INVENTION

This invention relates in general to systems and methods for operating a waste compactor and, more particularly, to systems and methods for controlling the operation of a compactor using among other things, a hydraulic digital pressure transducer, together with inputs and outputs which can also perform a periodic real-time oil viscosity measurement.

BACKGROUND OF THE INVENTION

The present invention provides an integrated system for complete trash compactor operation due to a "smart" control mechanism that also combines operational monitoring of the compaction operation including the operational condition and performance of the compactor as well as the need for maintenance—beyond fullness monitoring.

In various commercial, residential and industrial locations, it is common to use waste compactors for compaction of garbage and other trash or waste materials being disposed of. Such waste compactors often comprise a trash container, a hydraulic ram operative in compacting strokes for compacting the waste placed in the hopper of a container, and a hydraulic pump operative for advancing and retracting the ram in such manner that the hydraulic pressure is capable of being sensed between the pump and the ram.

Traditionally, waste producers contract with waste haulers to pick up and haul away accumulated waste. If the pick up is made too late, the container can pack out. If the pick up is made too early, then the cost of waste hauling is unnecessarily high.

In order to optimally time the pick up of a waste container and thereby prevent the waste compacter containers from packing out or otherwise interfering with the operation of the business or industry associated with the compactors, various systems have been established to arrange for the containers to be emptied prior to packing out. In particular, monitoring systems have been used in order to monitor the fullness of the containers. Oftentimes, the monitoring systems include a communication link to a remote computer, so that the remote computer may centrally manage the containers.

The present invention provides for not just remote monitoring, but remote diagnostics, as well. Such remote diagnostic capabilities include: hopper door open or closed; motor starter; and/or high oil temperature warnings and the like. The unit of the present invention itself can transfer such real-time diagnostic information with or without a central computer by SMS text message or email, to a recipient's cellular or wireless phone or a wireless device such as a PDA or computer capable of receiving such wireless communication messages. In that way, a critical condition or warning can be sent directly from the controller/monitor of the Packer Plus™ device of the present invention to the intended recipient in real time, so that any such operational or maintenance need of the compactor device can be addressed in a timely manner so as to proactively avoid problems caused by a failure to do so.

A prior art automated trash compactor system of Burgis, U.S. Pat. No. 4,953,109, unlike the present invention, uses a motor current sensor to generate ram forward and ram return signals. The ram return signal is generated when the current to the electric motor exceeds a predetermined value.

In contrast, the compactor control system of the present invention uses a hydraulic pressure transducer placed in the supply line to the shuttle valve and lacks pressure relief valves and/or limit switches found on conventional compactors.

At least one prior system for managing waste compactors is disclosed in U.S. Pat. No. 5,299,493 to Durbin. Generally, in at least one embodiment of such a system, fullness monitoring is accomplished by monitoring the amount of force or hydraulic pressure over one or more strokes of the hydraulic ram during the compaction operation. The sensed pressure is then analyzed and a maximum generated signal pressure value is compared against set threshold values to determine the level of fullness of the container. If the maximum generated signal pressure value exceeds the maximum set threshold value, the monitoring system initiates a pick-up request.

However, while prior monitoring systems have monitored the fullness of containers, such systems have not combined such monitoring with controlling operation, much less how various factors, including the climate, the type and age of the equipment, and the control system, can affect the operation of the waste compactors and, in particular, the hydraulic rams and associated pressures. Accurately determining or calculating the pressures associated with particular compactors is particularly important to prevent damage to the hydraulic ram. In particular, during extend and retract strokes, if the system is not properly set, the hydraulic ram may contact or "bang" at the end of the stroke due to bottoming out, thereby potentially damaging the hydraulic ram and/or other features of the compactor, and thereby decrease the life and the functionality of the of the ram and/or other system components.

Additionally, while known to use hydraulics, present systems do not account for viscosity changes that affect the ram velocity and pressure measurements, and therefore ram extension/retraction travel time. Such viscosity changes may occur for a variety of reasons including extreme temperature variations or frequent use of the compactor resulting in the heating of the hydraulic fluid.

Therefore, there is a need to produce a trash compactor controller/monitor system that controls the operation of the compactor, while permitting the fullness pressures to be calculated for the particular container and allowing for periodic real-time oil viscosity measurements to account for changes in viscosity, while being economical and easy to manufacture.

Indeed, the present invention actually employs the following technologies: one which controls the operation of the compactor based on "learned" empirical time constants and a hydraulic pressure transducer placed in the supply line to the shuttle valve; a second which performs periodic real-time oil viscosity measurement so as to allow the system to adjust the "learned" empirical constants, as needed; and the monitoring of the operation of the compactor and fullness of the container, as disclosed in U.S. Pat. No. 6,738,732 to Durbin et al.

SUMMARY OF THE INVENTION

The present compactor controller system is an improvement over the prior trash compactor systems, among other things, in connection with the way that the system tailors each controller to adapt to the attached hydraulic ram of the compactor, and the way that the system accounts for changes in viscosity are novel and improvements over the prior art. In particular, the system of the present invention provides for complete operation of the hydraulic system and monitoring thereof, including controls, comprehensive diagnostics with the capability of remote wireless communication in various forms directly to the intended recipient, from the controller/ monitor with or without the need for a central computer, that serves to facilitate proactive avoidance of compactor maintenance and operational issues, and usage and fullness detection and reporting. With the system of the present invention, the state of the hydraulic system in the compaction process is known at any time.

Each compactor comprises a hydraulic system operative in compacting strokes for compacting waste placed within the hopper of the container, and a hydraulic pump operative for applying hydraulic pressure to advance and retract the ram during compacting strokes of the compactor. A power pack comprises all electrical and hydraulic system components of the compactor system, except for the ram and the container. Each system comprises a microprocessor-based hydraulic ram controller/monitor which communicates its status via modem, fax, wireless, SMS text message, cellular, conventional telephone call, pager, WiFi, GSM, GPRS or any other known mode of Internet, VOIP, Ethernet, network or wired form of communication. A circuit board containing a microprocessor controls the operation of the compactor based on learned empirical time constraints and pressure calculations for a particular compactor and a hydraulic pressure transducer placed in the supply line to the shuttle valve. Based on the learned time constraints and pressure calculations, and the pressure values from the pressure transducer, in addition to controlling the operation of the compactor, the system monitors such operation and, among other things, originates and sends messages regarding the operation and/or need for maintenance of the system. If the sensed pressure value exceeds the calculated maximum pressure value, the system is capable of initiating a pick-up request or other information regarding operation or maintenance for the system by any of the aforementioned methods of communication and other comparable communication means. The system can be adjusted to the particular hydraulic pressure characteristics of the particular model of compactor.

The system of the present invention also provides for periodic real-time oil viscosity measurements. In one embodiment, the system subjects the pressure transducer to a short pulse of pressure and then monitors the decay envelope subsequent to the removal of the pressure. The direct estimation of the viscosity will allow the system processor to adjust the learned empirical constraints and permit the more efficient operation of the system and inhibit damage to the hydraulic ram and/or containers during use.

In determining fullness of a conventional compaction system, sometimes a pressure rise or spike can be seen by the transducer when a ram is near the end of a compaction stroke or when the ram is being retracted. The system of the present invention while controlling the actual compactor operation, provides that such pressure spikes are ignored by the fullness determination algorithm as appropriate for proper operation.

It is also an object of the present invention to provide an integrated assembly to enable sequencing of the operation to be configured both on site and via remote access by modem, wireless, VOIP or other appropriate internet protocol, cellular or Ethernet, so as to configure trash compactor operation and monitoring including multiple compaction and pre-crusher modes.

It is another object of the present invention to provide for a trash compactor system that may be easily tailored for specific model and/or installation requirements.

Yet another object of the present invention is to provide a new and improved trash compactor controller/monitor system that allows measurement of viscosity changes in the hydraulic fluid, to allow for appropriate adjustment of the timing of the compactor stroke for optimum operation of the system.

Another object of the present invention is to provide for a new and improved trash compactor controller/monitor system that controls the operation of a compactor based on learned empirical time constraints and using among other things, a hydraulic pressure transducer.

A further object of the present invention is to provide for a trash compactor assembly that may be deployed in harsh electrical and environmental conditions, due to among other things, the ability to adjust for changes in viscosity.

It is another object of the present invention to provide comprehensive and real time remotely communicated diagnostics reports and warnings communicated directly from the controller/monitor to intended recipients to facilitate and accelerate troubleshooting of compactor maintenance and performance issues.

It is yet another object of the invention to provide a unique learn mode wherein each controller is tailored to adapt to the particular hydraulics and performance characteristics of the compactor to which it is attached.

It is yet another object of the present invention to provide a trash compactor monitoring and operational control system that is economical and easy to manufacture and use.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
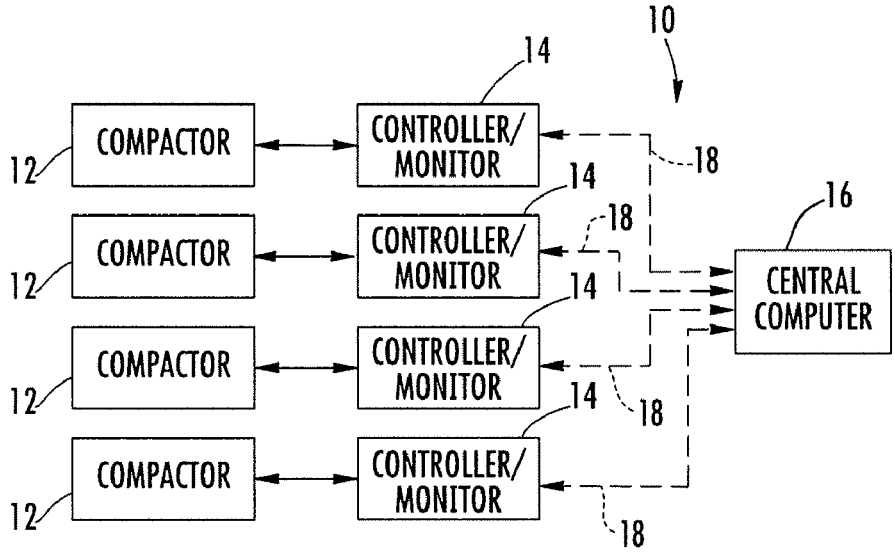
FIG. 1 is a block diagram of a waste compactor network with an optional central computer.

While this invention is capable of embodiment in many different forms, there is shown in the drawings and will herein be described in detail several specific embodiments, with the understanding that the present disclosure is to be considered merely an exemplification of the principles of the invention and the application is limited only to the appended claims.

Figure 1A:
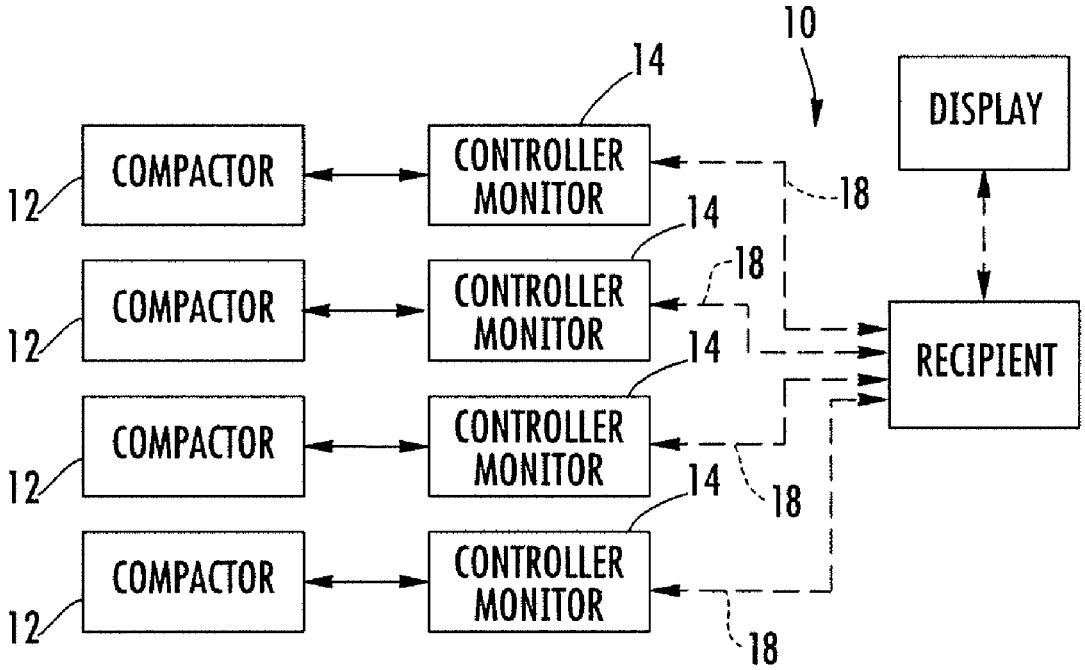
FIG. 1A is a block diagram of a waste compactor network providing direct communication to the recipient from the controller/monitor.

Referring now to the drawings, and particularly to FIGS. 1A through 3, there are shown preferred embodiments of the present invention. While the embodiment of FIG. 1A shows a single recipient for ease of illustration, it can include multiple recipients.

In the embodiments shown, the system comprises an integrated system for operating and monitoring one or more trash compactors. In particular, the system provides for: control/monitoring of the trash compactors; control and/or operation of the hydraulic system; comprehensive diagnostics for facilitating maintenance issues; and means for determining, monitoring and/or reporting on the operation, usage and fullness of the compactor associated with the system. While the embodiment shown and disclosed relates to a waste compactor system, it is appreciated that the system of the present invention may be configured to operate and monitor a baler as well and not depart from the scope of the present invention. Additionally, it is appreciated that the sequencing of operation for the system can be configured on-site or remotely for standard operation, multiple compaction, pre-crushers, safety features or other known operations.

FIG. 1A illustrates a block diagram of an embodiment of the compactor container network 10. One or more waste compactors 12 are shown, each compactor container having a respective control/monitoring unit 14. In the illustrated example embodiment, the control/monitoring units 14 communicate directly with tone or more recipients via a corresponding communication link 18, which can incorporate wire-based and/or wireless type communication systems, though only one recipient is shown in the example of FIG. 1A.

FIG. 1 illustrates a block diagram of an exemplary compactor container network 10 according to at least a second embodiment of the present invention. The compactor network includes one or more waste compactors 12, each compactor container having a respective control/monitoring unit 14. In the illustrated example embodiment, the control/monitoring units 14 in this embodiment communicate with central computer 16 via a corresponding communication link 18, which can incorporate wire-based and/or wireless type communication systems, though the central computer 16 is not required. The controller can be comprised of a single board computer or controlled circuit board.

It will be understood by those of ordinary skill in the art that the present invention is applicable to compactor networks having any number of compactors and respective monitoring units. In some instances, the number of compactors in a compactor network can exceed hundreds, thousands or more.

In order to allow for the system to efficiently work with compactors in different locations, it is appreciated that the system may utilize different communication mediums between the controller/processor and the compactors for remote operational settings and diagnostics. In a preferred embodiment, the container network supports all communication modalities (e.g., Ethernet, wireless, GSM, SMS, WiFi, other web-based systems and modem).

Figure 2:
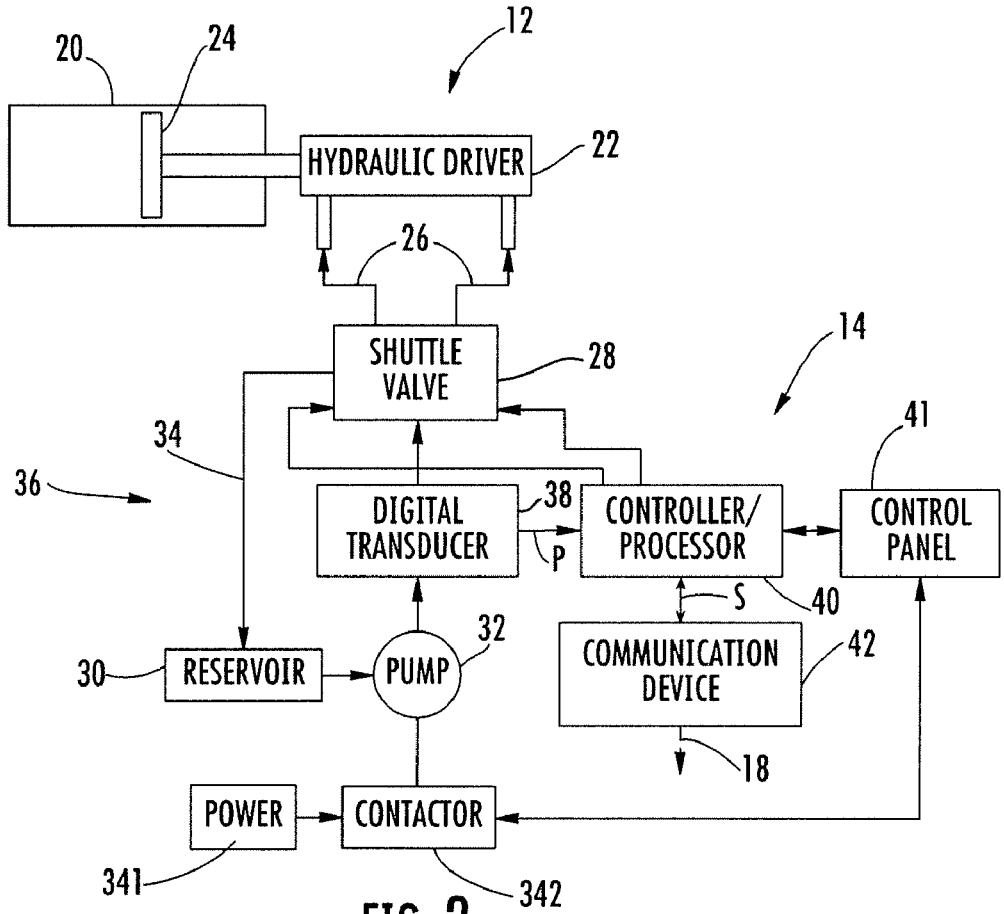
FIG. 2 is a block diagram of one embodiment of a waste compactor and a corresponding control/monitoring unit for use in the waste compactor illustrated in FIG. 1 showing, among other things, the valve controls.

Referring to FIG. 2, a typical waste compactor, generally depicted by the reference numeral 12, includes a container 20, equipped with a compacting assembly having a hydraulic driver 22 which includes a ram 24, to compact waste received in container 20. The hydraulic driver 22 receives pressurized hydraulic fluid via hydraulic lines 26 to effect reciprocal movement of the ram 24 in a controlled manner using a shuttle valve 28. Hydraulic fluid is stored in a reservoir 30 which under the control of a pump 32 and during the compaction of the waste contents in the container 20, provides pressurized hydraulic fluid to the shuttle valve 28, which is returned from the shuttle valve 28 to the reservoir 30 via a return line 34. As will be recognized by those of ordinary skill, the reservoir 30, pump 32, shuttle valve 28 and return line 34 form a hydraulic circuit 36. The aforementioned compactor structure is well known in the art and the details thereof are set forth in U.S. Pat. No. 5,303,642 to Simon et al., the entire writing and subject matter of which are incorporated herein by reference. A control panel 41 is preferably attached to the controller/processor 40 to permit a user to operate, control and monitor the compactor 12 on-site.

The control unit 14 includes control panel 41, power source 341, contactor (or relay) 342, controller/processor 14 and digital transducer 38 provides an indication of the status of container 20. For example, the control/monitoring unit 14 comprises a digital pressure transducer 38 disposed in the hydraulic fluid path of the hydraulic circuit 36 at the outlet of the pump 32 to generate a signal (P) indicative of the hydraulic pressure being applied to the hydraulic driver 22. In the preferred embodiment, the pressure transducer reads the pressure digitally as digital signals are not as prone to interference from other signals. The signal (P) is conveyed to a controller/processor 40, which preferably includes a microprocessor executing appropriate instructions for determining the compactor container status, based on the signal (P), and generating a compactor container status signal (S), representing status information associated with the container 20. The use of a digital pressure transducer 38 also eliminates the need for mechanical hydraulic pressure switches and makes it possible, in a preferred embodiment, to adjust the pressure levels both on-site and remotely.

The control/monitoring unit 14 may determine the compactor container status locally, and an example of such is similarly disclosed in U.S. Pat. No. 5,303,642 to Simon et al. By determining the maximum pressure experienced by the digital transducer 38 during one or more compaction strokes of the ram 24, the control/monitoring unit 14 can produce a compactor container status signal (S) representative of the status of the compactor container including, but not limited to the level of fullness. An indication of the level of fullness can be either determined locally and communicated as part of the compactor container status signal (S), or the details of the one or more compaction strokes including the information representative of the hydraulic pressures (P) applied to the hydraulic driver 22 during the compaction stroke, can be communicated to a controller/processor 40. However, the fullness determination is currently performed on site.

In addition to determining the maximum pressure (P) experienced during one or more compaction strokes, the monitoring and storage of multiple pressure readings over time throughout a compaction stroke can similarly be beneficial. Together, the multiple monitored pressure readings (P) can be used to form a pressure curve or envelope, which is representative of the operation of the waste compactor and the container status.

The system also may graphically display the monitored information corresponding to the compaction cycles to provide for the operational status of the compactor 12. In one embodiment, the stroke profiler in the form of a graph profiles strokes (preferably in 1/10 second segments) to indicate how efficiently the compactor 12 is operating. It can show worn shoes, trash behind ram and pressure profile of the operation of the ram in both forward and reverse cycle, including other maintenance issues. For example, a jam can be predicted if the pressure builds too soon.

The details of such a system are set forth in U.S. Pat. No. 6,738,732 to Simon et al., the entire writing and subject matter of which are incorporated herein by reference.

By analyzing or reviewing the multiple pressure readings, it is possible to determine and diagnose potential operational problems, which might be occurring in connection with the operation of the waste compactor. For example, the pressure curve(s) of recent waste compactions can be reviewed against one or more sets of previously stored expected or baseline pressure curves. It is similarly possible to review recent pressure curves in combination with sets of pressure curves monitored and recorded during waste compactions in which known problems or failures were occurring. In this way it may be possible to diagnose the existence of a fault or a failure, and in some instances it may also possible to identify a specific type of failure on site or remotely.

A predetermination of possible failures can be very useful, in that this knowledge could be used by a service technician to insure that he or she is equipped to efficiently handle and diagnose the likely potential problems being experienced by the waste compactor. For example, the technician could insure he or she has available diagnostic equipment and/or spare parts specific to the anticipated failure(s), thereby making it more likely for the problem(s), if any, to be quickly and cost-effectively resolved. In addition, in one embodiment, a preventive maintenance module logs operating conditions to predict and request on-demand maintenance service. For example, a maximum number of compactions and/or hours of operations may be set, wherein the system will initiate a maintenance service call when the set parameter is obtained. In addition, the module may also record the complete maintenance history for the compactors, including the actual time spent to service the compactor for substantiating invoice charges.

The control/monitoring unit 14 also includes a communication device 42, such as, but not limited to, a modem, in communication with the status processor 40, which can communicate to an optional computer 16, another remote computer, or another communication device or receiver (not shown) through a communication link/interface 18. The communication device 42 conveys the status signal (S) via a communication link 18, which as noted previously may incorporate a wire-based type communication system such as a telephone network, and/or a wireless communication system such as cellular or radio communication networks. In this way, a 2-way communication system is provided for inquiry into the status of the system or auto transmission of the system status to one or more recipients.

Figure 3:
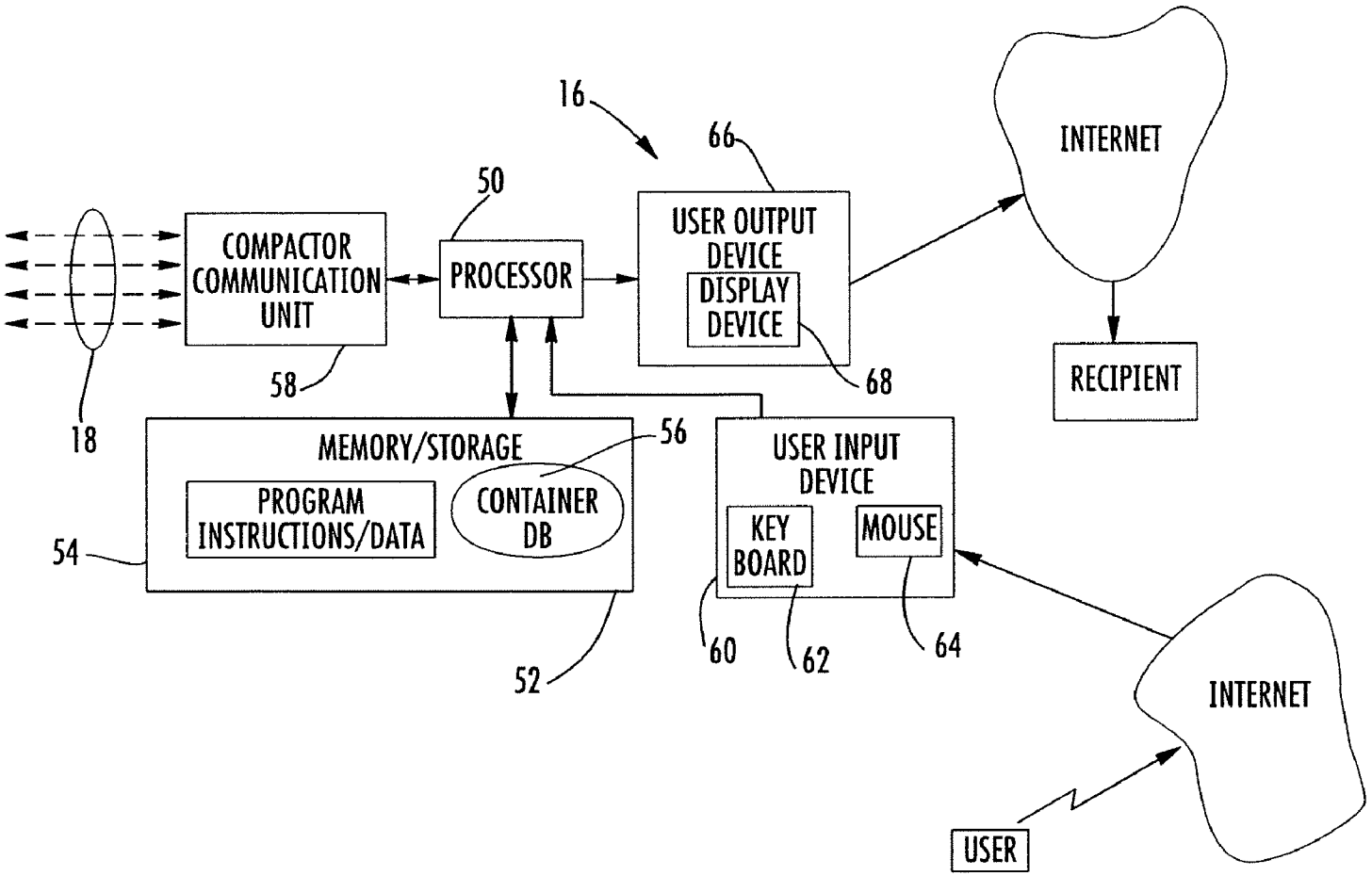
FIG. 3 is a block diagram for one embodiment of a computer for managing one or more waste compactors such as the compactors of the type illustrated in FIG. 2.

In at least one embodiment, the optional central computer 16, as illustrated in FIG. 3, includes a processor 50. The processor 50 is coupled to memory/storage 52, which contains program data and program instructions 54 for use by the processor 50. The memory/storage 52 can take the form of one or more well known forms of memory and/or storage devices and include solid state memory devices, like random access memories (RAM), or read only memories (ROM), and auxiliary storage devices, such as optical or magnetic disk storage units. In the illustrated embodiment, the memory/storage 52 further includes a container database structure 56. Generally, the program data and instructions will be stored in a digital format, which can be read or written by the processor 50.

Under the control of the program instructions, the processor 50 will communicate with the monitoring units 14 of the one or more compactor containers 12 via a compactor communication unit 58 or interface. The compactor communication unit 58 can take one or more of several well known forms of communication. For example, similar to the communication device 42 of the control/monitoring unit 14, the compactor communication unit 58 could include a modem for communicating over a telephone line connection, an ethernet connection, a radio transceiver for communicating over a wireless communication connection, as well as multiple other well known forms of communication such as GSM, SMS, cellular phone etc. The specific form of communication of the compactor communication unit 58, however, should generally be compatible with the form of communication used by the communication device 42. In at least one instance, communication between the compactor communication unit 58 and the communication device 42 of the control/monitoring unit 14 can occur via a public global wide area communication network, such as the Internet. As shown in FIG. 3, one or more users can access the system via the internet or via a wireless network or the like, though for ease of illustration, only one user is shown in the example of FIG. 3. Likewise the system can communicate with a recipient via the internet or a wireless network. Similarly, in the embodiment of FIG. 3, the system can communicate with multiple recipients via the internet or wireless networks.

Figure 4:
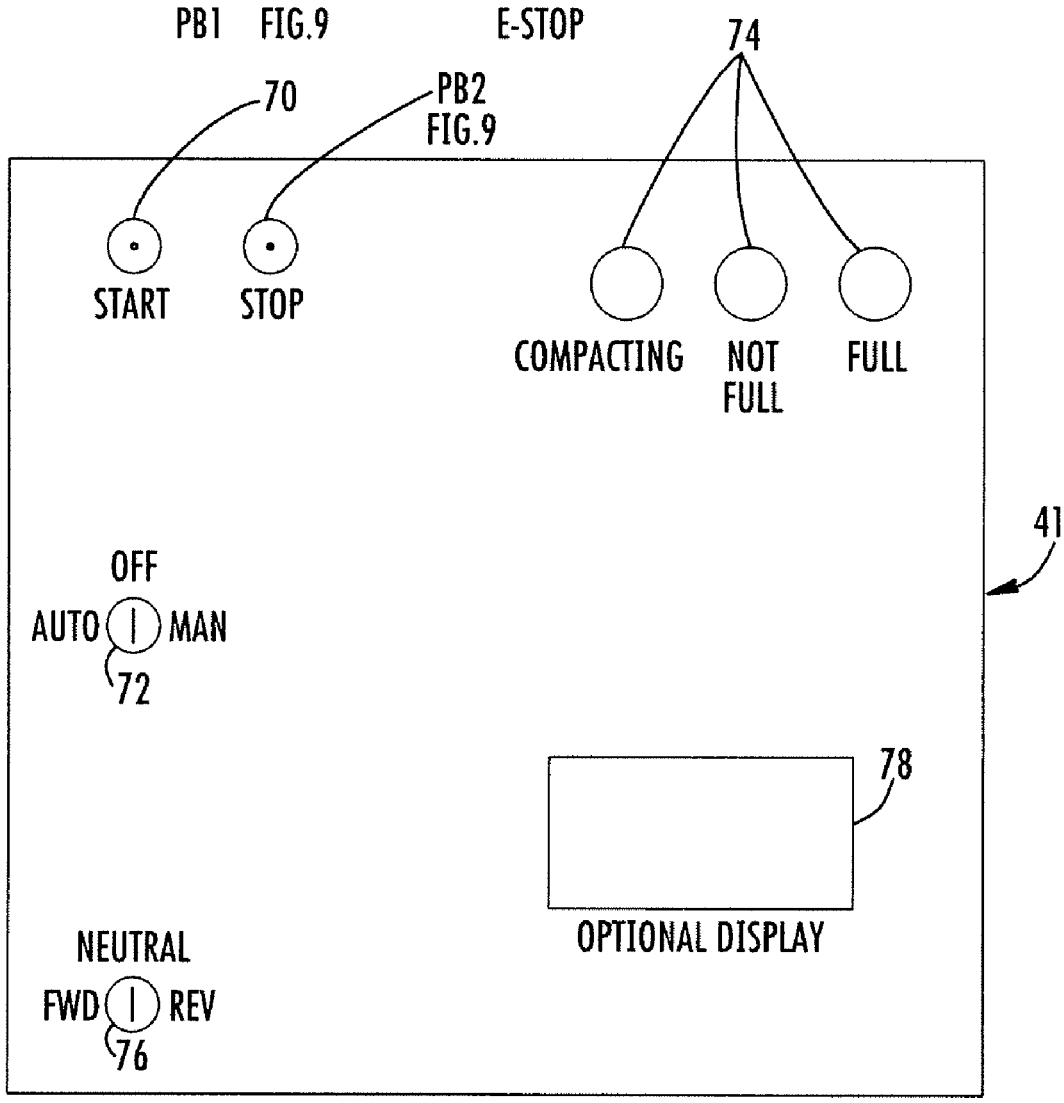
FIG. 4 is a front view of one embodiment of a control panel for use with the present invention.

Referring to FIG. 4, one example of a control panel for use with the present invention is shown. The control panel 41 includes a push button START switch 70, a mode switch 72, a series of indicators such as a plurality of lamps or lights 74 to indicate the state of the compactor (e.g., compacting, not full or full), and a hydraulic ram direction switch 76. The mode switch 72 is used to switch the compactor between the off position, automatic mode and manual mode. In one embodiment, the mode 72 and hydraulic ram 76 switches are key-activated to prevent unauthorized use of the compactor. In the automatic mode, the processor 40 of the system controls the hydraulic ram 24, while in the manual mode, the hydraulic ram 24 is controlled by the hydraulic ram switch 76. When in the manual mode, movement of the switch 76 to the forward position causes the hydraulic ram 24 to move in a forward direction, while movement of the switch 76 to the reverse position causes the hydraulic ram 24 to move in a reverse direction. An emergency stop or e-stop switch can be provided for immediate stopping of the system, shut off of all power to the system and reduction of the pressure to a neutral state.

In an alternative embodiment, panel 41 could be remote from the controller. As shown in FIG. 4, the external control panel 41 may also include an optional rugged outdoor diagnostics display or indoor LCD type display 78 (depending upon whether the display will be used outdoors or indoors, respectively) to relay information to the compactor operator on-site concerning the condition of the compactor operation and the reasons for (or information on) any problems or actions taken or to be taken. Alternatively, the system is operated by using the monitor of a personal computer to display the diagnostics information and configure the system in lieu of the control panel 41 and not depart from the scope of the present invention.

A key pad, key switches or dedicated operational keys are attached to a single board computer as processor 40, as part of the controller processor board for affirmative and intended switching into the learn mode. A switch or menu on the screen is provided for selection of the learn mode. Learn mode is therefore not the default mode. A code, key or dedicated button is provided for learn mode. Alternatively, a dead man switch is provided for learn mode, so that only desired and intended operation of learn mode is possible.

Figure 5:
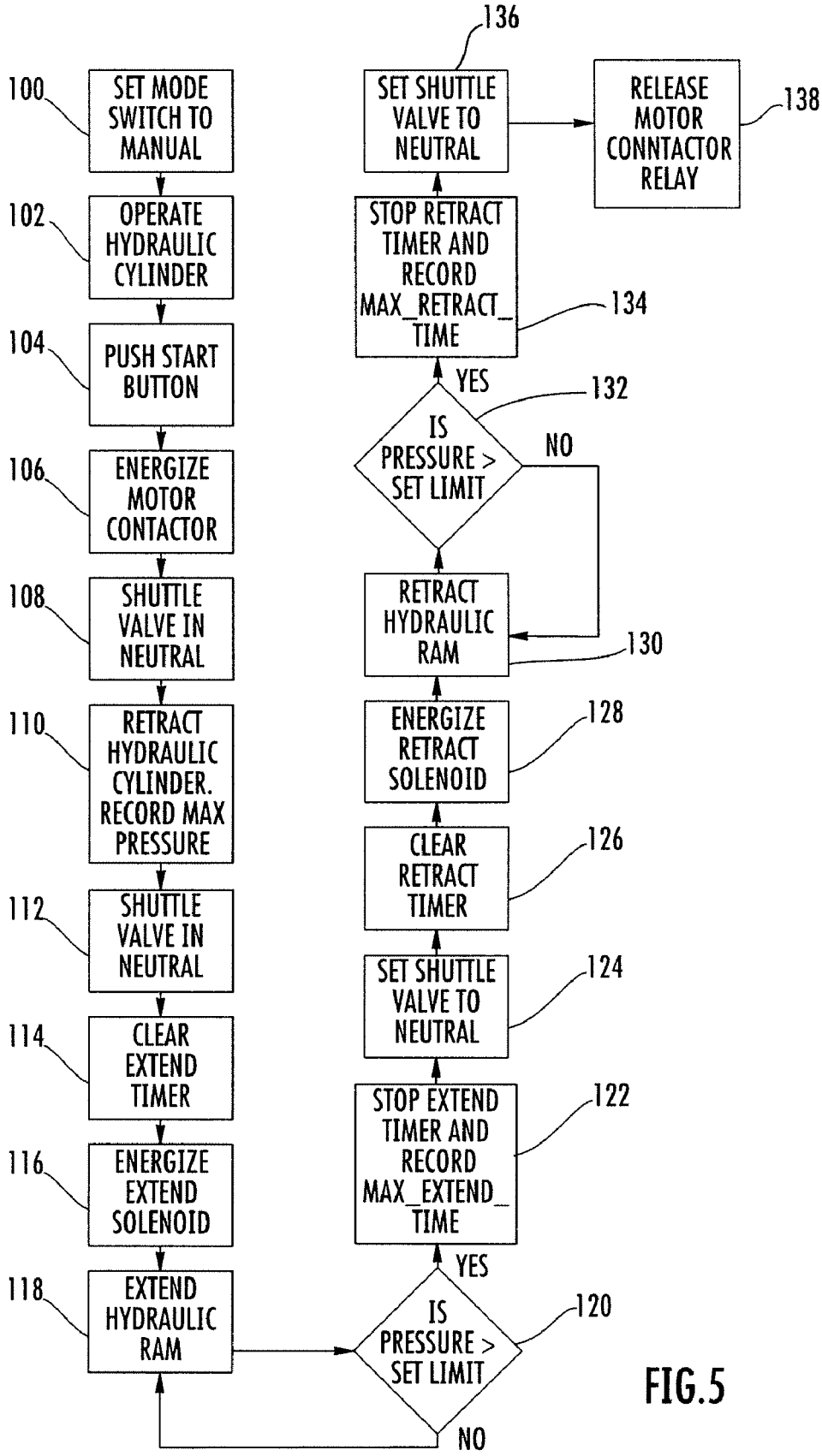
FIG. 5 is a flow diagram of the steps of one embodiment of the learn mode of the compactor controller of the present invention.

FIG. 5 illustrates a flow diagram of the steps involved in one embodiment of the learn mode of the present invention, which provides for extended life of the ram and compactor as it reduces and minimizes excess contact with the container (or banging) during the extend and retract strokes of the hydraulic ram. In the learn mode, if the viscosity of the hydraulic fluid changes, then the times for the extension and retraction portion of the cycle are adjusted. In other words the system learns or re-learns the proper amount of time for the ram to go from one end to the other. However, unauthorized manual changes to the ram stroke are precluded.

In order to start, the mode switch 72 of the control panel 41 is switched to the manual position in step 100. The hydraulic cylinder is then operated in step 102 using the hydraulic ram switch 76 until the hydraulic ram is in the fully retracted position. Once the hydraulic ram is in the fully retracted position, the start button or switch 70 may be pressed in step 104. The motor contactor is then energized in step 106 causing the hydraulic pump to operate. The numerical values used in the described embodiment are just used as an example. The shuttle valve 28 will then remain in neutral in step 108 for 1½ seconds. The hydraulic cylinder may then be retracted in step 110 via the shuttle valve 28 for three seconds, during which time, the MAX_PRESSURE is recorded. After the shuttle valve 28 shifts to neutral for one second in step 112, the extend timer is cleared in step 114. When the system energizes the extend solenoid and starts the extend timer in step 116, the hydraulic ram will extend in step 118 until the pressure transducer senses that the pressure change is equal or greater than a set pressure value (e.g., MAX-PRESSURE—200 PSI) at step 120.

Once the set pressure is reached or exceeded, the extend timer is stopped and the time is recorded as the MAX_EXTEND_TIME at step 122. The shuttle valve is then set to neutral for one second in step 124 and the retract timer is cleared in step 126. When the system starts the retract timer and energizes the retract solenoid in step 128, the hydraulic ram will retract in step 130 until the pressure transducer senses that the pressure is equal or greater than a set pressure value (e.g., MAX-PRESSURE—200 PSI) in step 132. Once the set pressure is reached or exceeded, the retract timer is stopped and the time is recorded as the MAX_RETRACT_TIME in step 134. The shuttle valve 28 is then set to neutral and the motor contactor relay is released in steps 136 and 138. During the above sequence, in a preferred embodiment, a safety shut-off timer monitors the extend and retract strokes, wherein if the safety shut-off timer exceeds a set value (e.g., 40 seconds), a fault exception will be thrown causing the shuttle valve 28 to be set to neutral and the system to notify the operator. The system is shown as setting the learned time constraints on-site. Remote operation of the compactor is not recommended due to safety concerns.

Figure 6:
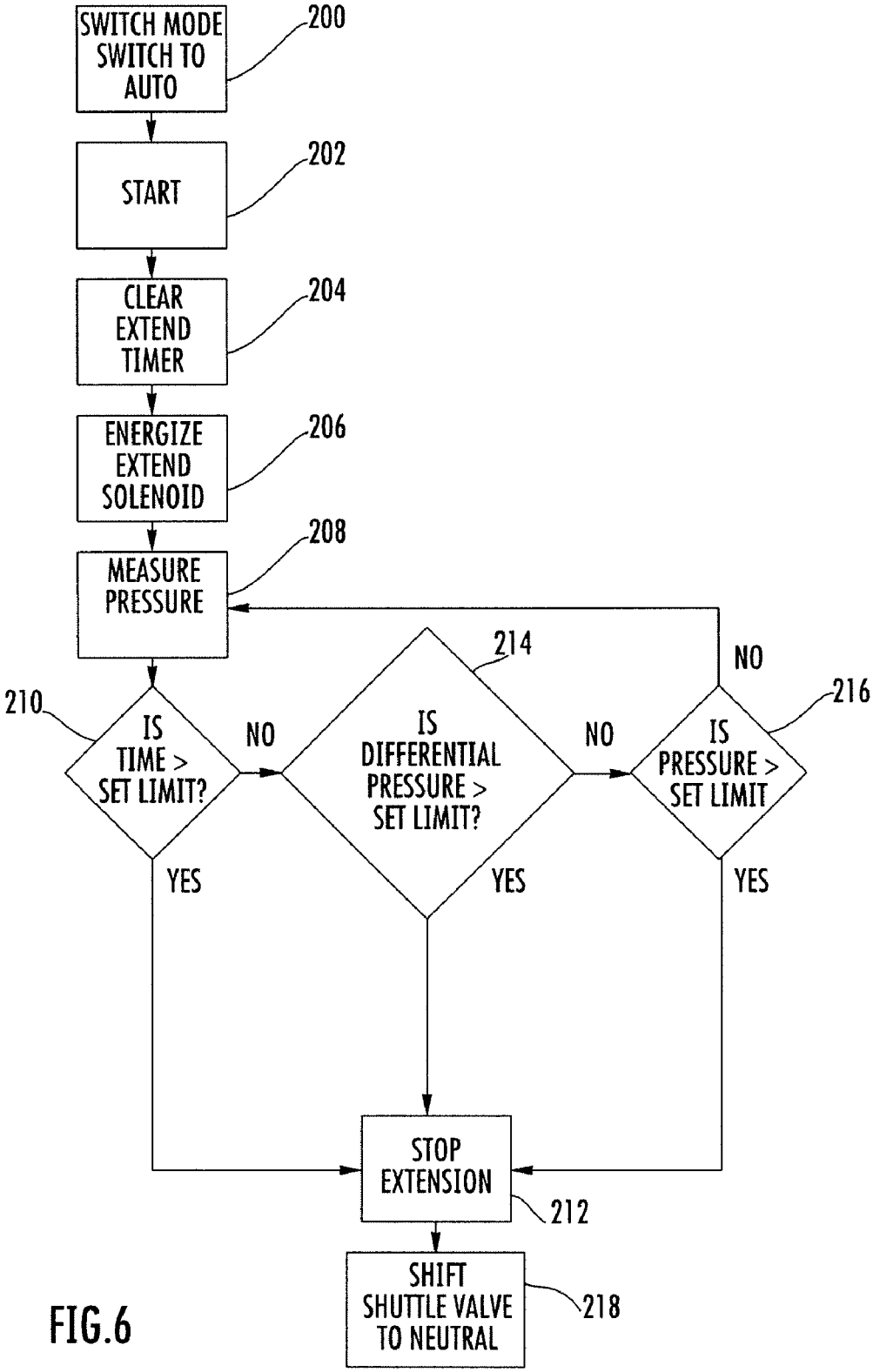
FIG. 6 is a flow diagram of the steps of one embodiment of the compactor operation mode of the standard extend stroke of the present invention.

FIG. 6 illustrates a flow diagram of the steps involved in one embodiment of the compactor operation mode of the extend stroke of the present invention. In order to start, the mode switch 72 is switched to the automatic position in step 200 and the start switch 70 is pressed in step 202, which causes the motor contactor to be pulled in and energize the hydraulic pump. The shuttle valve 28 also remains in neutral for 1½ seconds. Thereafter, the extend timer is cleared in step 204 and the extend solenoid is energized in step 206. While the hydraulic ram operates, the system will monitor the pressure in step 208. While the extend time is less than or equal to the set maximum time (e.g., MAX_EXTEND_TIME—2 seconds), the pressure will continue to be monitored in step 210. Otherwise, once the extend time equals the set maximum time, the extension of the hydraulic ram will cease in step 212. If the differential pressure rise is greater than 500 psi/sec (or other set value) in step 214, or if the average pressure exceeds the MAX_PRESSURE in step 216, the hydraulic ram extension may also be stopped in step 212. Once the hydraulic ram extension is stopped in step 212, the system will shift the shuttle valve 28 to neutral for one second in step 218. Accordingly, the parameter is modified by measuring the viscosity and modified at a time when a compaction operation is not in progress.

Figure 7:
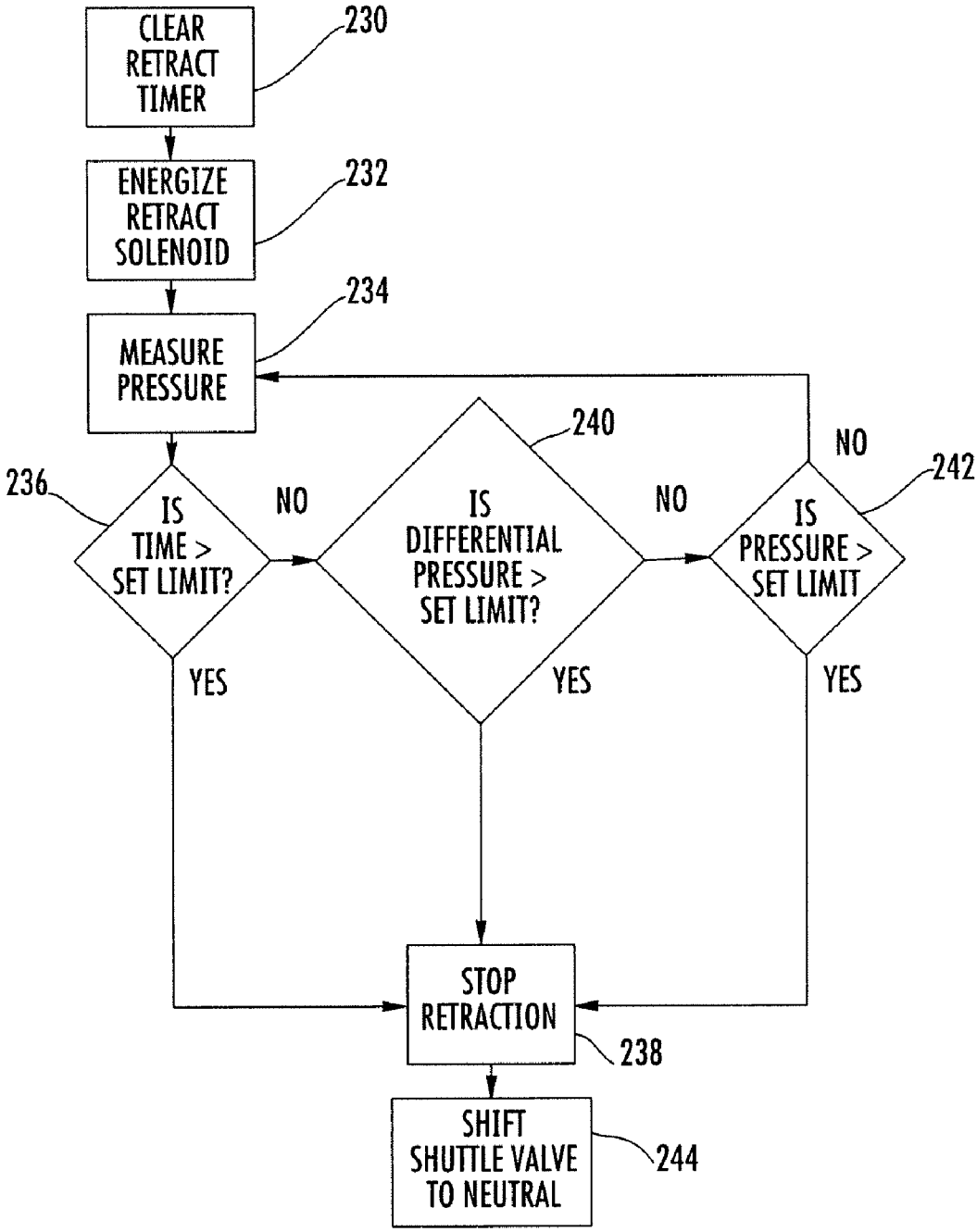
FIG. 7 is a flow diagram of the steps of one embodiment of the compactor operation mode of the retract stroke of the present invention.

FIG. 7 illustrates a flow diagram of the steps involved in one embodiment of the compactor operation mode of the retract stroke of the present invention. In order to start, the retract timer is cleared in step 230 and the retract solenoid is energized in step 232. While the hydraulic ram operates, the system will monitor the pressure in step 234. While the retract time is less than or equal to the set maximum time (e.g., MAX_RETRACT_TIME—2 seconds), the pressure will continue to be monitored in step 236. Otherwise, once the extend time equals the set maximum time, the retraction of the hydraulic ram will cease in step 238. If the differential pressure rise is greater than 500 PSI/sec (or other set value) in step 240, or if the average pressure exceeds the MAX_PRESSURE in step 242, the hydraulic ram extension also may be stopped in step 238. Once the hydraulic ram retraction is stopped in step 238, the system will shift the shuttle valve 28 to neutral for one second in step 244.

The result of such a "smart" control mechanism is enhanced hydraulic life because the ram life is extended by minimizing "banging" of the ram during the extend and retract strokes. Also provided is the capability to provide remote service calls.

Figure 8:
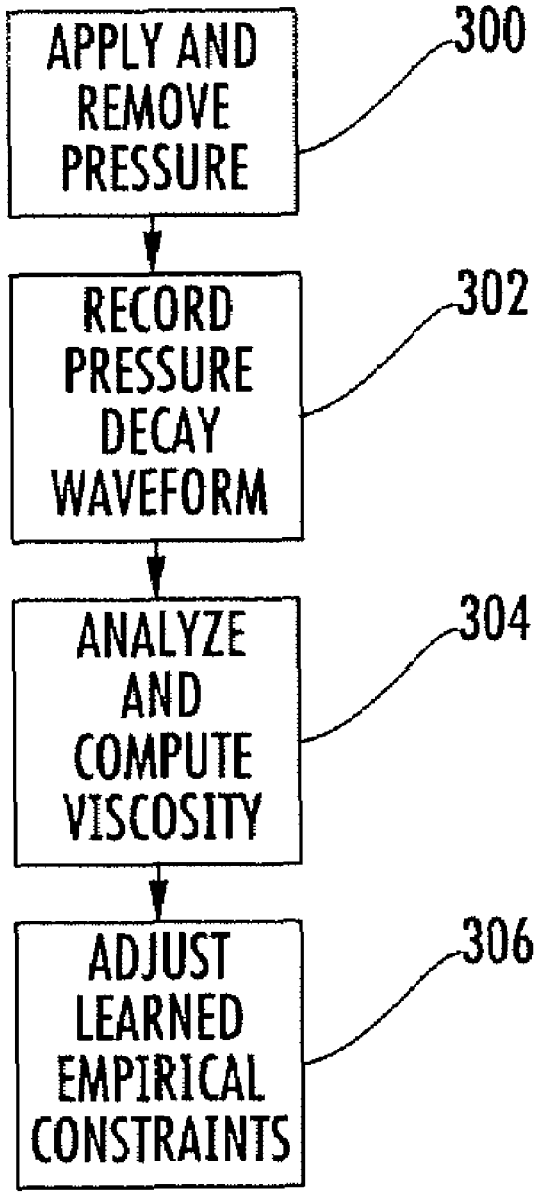
FIG. 8 is a flow diagram of the steps of one embodiment of the viscosity estimation process of the system of the present invention.

In order to account for viscosity changes due to extreme climate conditions, high use of the compactors, or other known or unknown conditions, the system is capable of performing periodic real-time oil viscosity measurements. A preferred method of calculating the viscosity changes is through the pressure decay principle technique. Referring now to FIG. 8, a flow chart of the steps involved in accounting for the viscosity changes in the system is illustrated. At the outset, the system applies and then removes pressure to the pressure transducer 38 in step 300 and then records the pressure decay waveform in step 302 before analyzing and computing the viscosity in step 304. In particular, the viscosity is mathematically related to the natural log of the pressure versus time when the oil is assumed to act as a Newtonian fluid and subjected to laminar flow. The system then adjusts the learned empirical constraints in step 306, as needed, using the viscosity estimates to assist in properly determining the fullness of the compactor and to eliminating damage to the hydraulic ram and/or container.

Figure 9:
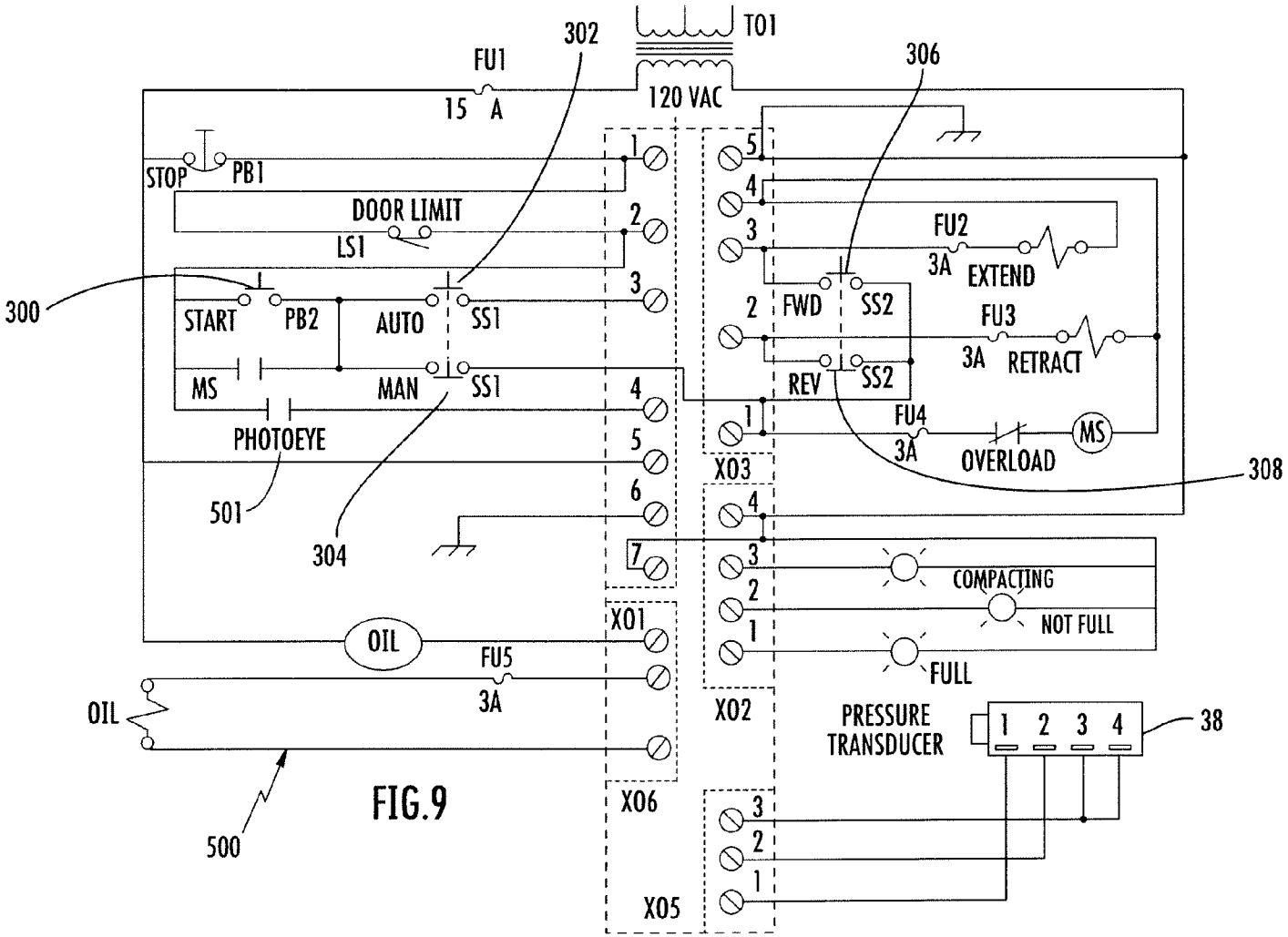
FIG. 9 is a schematic wire diagram of the system of one embodiment of the present invention.

A wiring diagram for the system of the present invention is shown in FIG. 9. Not shown is the communication module which can transmit operational or maintenance information wirelessly or otherwise remotely. In a preferred embodiment, the system utilizes an integrated solid-state design that reduces point-to-point wiring and eliminates external timers or relays. After the system is started 300 by pushing the start button 70 or otherwise initiating the system, the system may be set for automatic mode 302 or manual mode 304 through the use of the mode switch 72. If the automatic mode is selected, the hydraulic ram may be extended until such time as the pressure reading from the pressure transducer indicates that the maximum set pressure has been reached or exceeded (i.e., the container is overloaded) or the maximum set extend time has been reached, wherein the hydraulic ram extension will cease. If the manual mode is selected, the hydraulic ram may be extended 306 or retracted 308 through the hydraulic ram switch 76. Photoeye 501 is optional.

Also shown in FIG. 9 is optional "intelligent" oil heater assembly 500. Rather than have oil heater 500 on constantly, in the present invention, it is connected so that it is on only when actually needed so as to avoid wasting energy.

It will be understood that modifications and variations may be effected without departing from the scope of the novel concepts of the present invention, but it is understood that this application is limited only by the scope of the appended claims.

The invention claimed is:

1. A method for controlling the operation of a waste compactor having a hydraulic ram and a hydraulic pump operative for applying hydraulic pressure to advance and retract the ram during compacting strokes of the compactor, wherein the hydraulic pump comprises a measurable fluid having a viscosity, the method comprising the steps of:

establishing a maximum pressure for the hydraulic pressure;

establishing extend and retract time constraints for the hydraulic ram;

operating the hydraulic ram;

monitoring the hydraulic pressure while the hydraulic ram is operated;

estimating the viscosity of the fluid; and adjusting the extend and retract time constraints based on the estimated viscosity.

2. The method of claim 1 wherein the step of monitoring the hydraulic pressure comprises a pressure transducer.

3. The method of claim 2 wherein the pressure transducer is a digital pressure transducer.

4. The method of claim 2 wherein the step of estimating the viscosity of the fluid comprises the steps of:

application and removal of pressure to the pressure transducer; and monitoring a decay envelope associated with the pressure.

5. The method of claim 1 wherein the step of estimating the viscosity of the fluid occurs in substantially real-time.

6. A method for controlling the operation of a waste compactor having a hydraulic ram and a hydraulic pump operative for applying hydraulic pressure to advance and retract the ram during compacting strokes of the compactor, wherein the hydraulic pump comprises a fluid having a viscosity, the method comprising the steps of:

operating the hydraulic ram;

calculating empirical time constraints and maximum pressure readings for the hydraulic ram;

monitoring the hydraulic pressure while the hydraulic ram is operated;

estimating the viscosity of the fluid; and adjusting the empirical time constraints based on the estimated viscosity of the fluid.

7. The method of claim 6 wherein the step of monitoring the hydraulic pressure comprises a pressure transducer.

8. The method of claim 7 wherein the pressure transducer is a digital pressure transducer.

9. The method of claim 7 wherein the step of estimating the viscosity of the fluid comprises the steps of:

sending pressure to the pressure transducer; and monitoring a decay envelope associated with the pressure.

10. The method of claim 6 wherein the step of calculating empirical time constraints and maximum pressure readings comprises the steps of:

operating the hydraulic ram for a set period of time;

recording the maximum pressure during the set period of time;

establishing a maximum pressure reading;

clearing an extend timer associated with the hydraulic ram;

starting the extend timer;

monitoring the hydraulic pressure;

extending the hydraulic ram until the hydraulic pressure reaches the maximum pressure reading; and stopping the extend timer and recording the maximum extend time.

11. The method of claim 10, wherein the step of calculating empirical time constraints and maximum pressure readings further comprises the steps of:

clearing a retract timer associated with the hydraulic ram;

starting the retract timer;

monitoring the hydraulic pressure;

retracting the hydraulic ram until the hydraulic pressure reaches the maximum pressure reading; and stopping the retract timer and recording the maximum retract time.

12. The method of claim 10 wherein the maximum pressure reading is less than the recorded maximum pressure.

13. The method of claim 10 wherein the maximum pressure reading is substantially equal to the recorded maximum pressure.

14. The method of claim 6 wherein the step of estimating the viscosity of the fluid occurs in substantially real-time.

15. A system for controlling the operation of a compactor system having a hydraulic ram and a hydraulic pump operative for applying hydraulic pressure to advance and retract the ram during compacting strokes of the compactor, wherein the hydraulic pump comprises a fluid having a measurable viscosity, the system comprising:

means for establishing a maximum pressure for the hydraulic pressure;

means for establishing time constraints for the hydraulic ram;

a pressure transducer for monitoring the hydraulic pressure while the hydraulic ram is operated;

means for estimating the viscosity of the fluid; and means for adjusting the time constraints pressure based on the estimated viscosity.

16. The system for controlling the operation of a waste compactor of claim 15 which further comprises:

means for operating the hydraulic ram until the hydraulic pressure reaches the maximum pressure.

17. The system for controlling the operation of a waste compactor of claim 15 which further comprises:

means for establishing a maximum extend time and a maximum retract time for the hydraulic ram; and means for adjusting the maximum extend time and maximum retract time based on the estimated viscosity.

18. The system for controlling the operation of a waste compactor of claim 15 which further comprises:

means for timing the extension and retraction of the hydraulic ram;

means for operating the hydraulic ram for a first time period until the first time period for the extension of the hydraulic ram reaches the maximum extend time or the hydraulic pressure reaches the maximum pressure; and means for operating the hydraulic ram for a second time period until the second time period for the retraction of the hydraulic ram reaches the maximum retract time or the hydraulic pressure reaches the maximum pressure.

19. The system for controlling the operation of a waste compactor of claim 15 wherein the viscosity of the fluid is estimated in substantially real-time.

20. A system for controlling the operation of a waste compactor having a hydraulic ram and a hydraulic pump operative for applying hydraulic pressure to advance and retract the ram during compacting strokes of the compactor, wherein the hydraulic pump comprises a fluid having a viscosity, the system comprising:

a hydraulic pressure sensor for measuring the hydraulic pressure, and a processor for executing a plurality of prestored instructions including:

instructions for retracting the hydraulic ram for a set period of time and recording a maximum pressure;

instructions for establishing a maximum pressure reading;

instructions for extending the hydraulic ram until the hydraulic pressure reaches the maximum pressure reading;

instructions for recording the time it takes for the hydraulic pressure to reach the maximum pressure reading during the extending of the hydraulic ram; and instructions for establishing a maximum extend time.

21. A system for controlling the operation of a compactor system having a hydraulic ram and a hydraulic pump operative for applying hydraulic pressure to advance and retract the ram during compacting strokes of the compactor, wherein the hydraulic pump comprises a fluid having a viscosity, the system comprising:

a pressure transducer for measuring the hydraulic pressure; and a processor for executing a plurality of prestored instructions including:

instructions for retracting the hydraulic ram for a set period of time and recording a maximum pressure;

instructions for establishing a maximum pressure reading;

instructions for extending the hydraulic ram until the hydraulic pressure reaches the maximum pressure reading;

instructions for recording the time it takes for the hydraulic pressure to reach the maximum pressure reading during the extending of the hydraulic ram; and instructions for establishing a maximum extend time.

22. The system for controlling the operation of a compactor system of claim 21 wherein the maximum pressure reading is the recorded maximum pressure.

23. The system for controlling the operation of a compactor system of claim 21 wherein the maximum pressure reading is a value less than the recorded maximum pressure.

24. The system for controlling the operation of a compactor system of claim 21 wherein the process further comprises:

instructions for retracting the hydraulic ram until the hydraulic pressure reaches the maximum pressure reading;

instructions for recording the time it takes for the hydraulic pressure to reach the maximum pressure reading during the retraction of the hydraulic ram; and instructions for establishing a maximum retract time.

25. A system for controlling the operation of a compactor system comprising:

a waste container for receiving waste material;

a hydraulic ram;

a hydraulic pump operative for applying hydraulic pressure to advance and retract the hydraulic ram during compacting strokes of the compactor, wherein the hydraulic pump comprises a fluid having a viscosity;

a pressure sensor; and a processor operatively connected to the pressure sensor and the hydraulic ram to operate the hydraulic ram and calculate a maximum pressure for the hydraulic pressure, estimate the viscosity of the fluid and adjust the maximum pressure based on the estimated viscosity.

26. The system for controlling the operation of a compactor system of claim 25 wherein the pressure sensor comprises a pressure transducer.

27. The system for controlling the operation of a compactor system of claim 25 which further comprises means to time the compacting strokes of the compactor, and wherein the processor also calculates empirical time constraints for the operation of the hydraulic ram and adjusts the empirical time constraints based on the estimated viscosity.

28. The system for controlling the operation of a compactor system of claim 25 wherein the processor operates the hydraulic ram until the hydraulic pressure reaches the maximum pressure.

29. The system for controlling the operation of a compactor system of claim 27 wherein the processor operates the hydraulic ram until the hydraulic pressure reaches the maximum pressure or the empirical time constraints are reached.

30. A system for controlling the operation of a compactor system comprising:

a waste container for receiving waste material;

a hydraulic ram;

a hydraulic pump operatively connected to the hydraulic ram for applying hydraulic pressure to advance and retract the hydraulic ram during compacting strokes of the compactor, said hydraulic pump comprising a hydraulic fluid having a measurable viscosity;

means for measuring changes in the viscosity of the hydraulic fluid;

means for monitoring the fullness of the waste container operably associated with the hydraulic ram; and means for controlling the advancing and retracting of the hydraulic ram during the compacting strokes of the compactor based on changes to the viscosity of the hydraulic fluid.

* * * * *